United States Patent [19]

Brophy

[11] 3,948,482

[45] Apr. 6, 1976

[54] CAMPER JACKS

[76] Inventor: Carl R. Brophy, Box 122, Clackamas, Oreg. 97015

[22] Filed: Aug. 21, 1975

[21] Appl. No.: 606,476

[52] U.S. Cl. ..... 254/4 R; 248/188.6; 254/47; 280/36 R

[51] Int. Cl.[2] ..... B66F 7/26

[58] Field of Search ..... 254/4 R, 4 B, 4 C, 45, 254/47; 280/36 R; 248/188.7, 188.6, 98, 129, 121–125, 170, 171

[56] References Cited

UNITED STATES PATENTS

| | | | |
|---|---|---|---|
| 2,932,526 | 4/1960 | Campbell | 248/98 |
| 2,964,293 | 12/1960 | Foth | 254/4 C |
| 3,305,216 | 2/1967 | Gennaro et al. | 254/47 |
| 3,314,655 | 4/1967 | Steele | 254/45 |
| 3,507,476 | 4/1970 | Bennett | 254/45 |
| 3,841,603 | 10/1974 | Lund | 254/47 |

*Primary Examiner*—Al Lawrence Smith
*Assistant Examiner*—Robert C. Watson
*Attorney, Agent, or Firm*—Klarquist, Sparkman, Campbell, Leigh, Hall & Whinston

[57] ABSTRACT

A tripod camper jack has two legs fixed to a post support and a third leg hinged to the support for movement between an operative position extending away from the fixed legs and a folded position folded back along a first one of the fixed legs. The second one of the fixed legs carries a roller and the third leg carries a second roller. When the third leg is in its folded position, the rollers are aligned and the jack may be tilted to raise feet of the fixed legs and rolled on the rollers. In an alternate embodiment, a saddle is secured to a slide on the post in either an operative position extending crosswise of the post or a storage position extending lengthwise of the post.

7 Claims, 4 Drawing Figures

CAMPER JACKS

DESCRIPTION

This invention relates to improved camper jacks and has for an object thereof the provision of new and improved camper jacks.

Another object of the invention is to provide a tripod camper jack which can be folded to a compact storage position and being rollable only when folded.

A further object of the invention is to provide a tripod camper jack having a folding leg with rollers on the folding leg and one of the other legs, the rollers being elevated and inoperative when the folding leg is in an unfolded position and being aligned and operative when the folding leg is in a folded position and the jack is tilted.

Another object of the invention is to provide an improved camper jack having folding legs and a saddle pivotal to a storage position.

Figure 1:
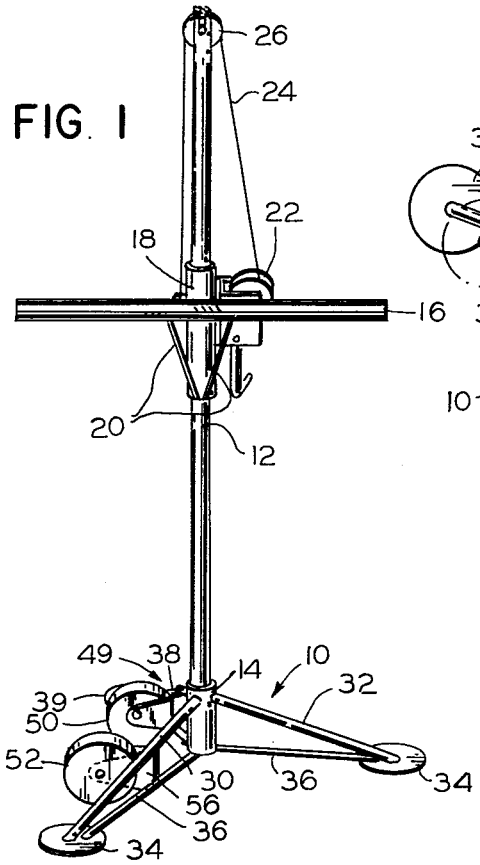
FIG. 1 is a perspective view of an improved camper jack forming one embodiment of the invention.
Figure 2:
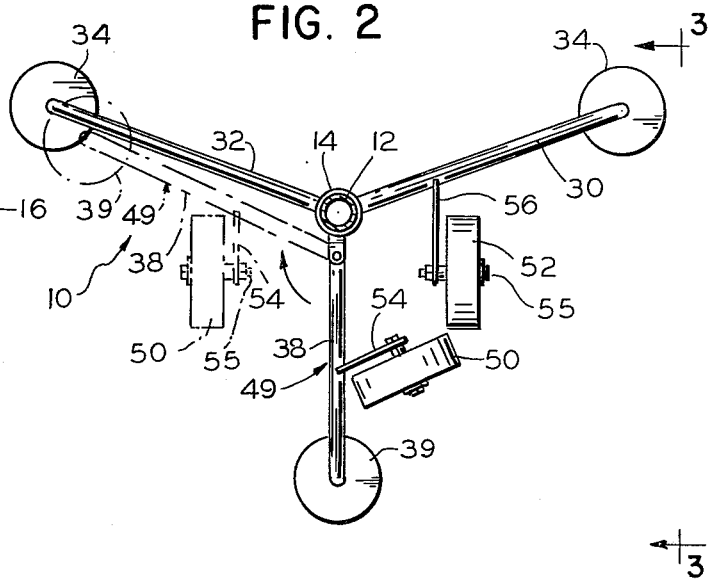
FIG. 2 is an enlarged horizontal sectional view of the jack of FIG. 1.
Figure 4:
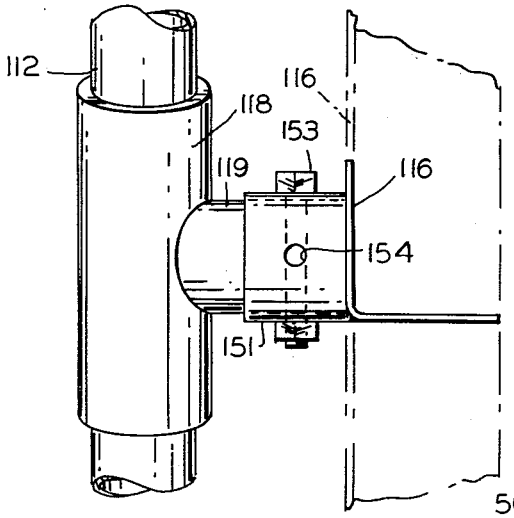
FIG. 4 is an enlarged, fragmentary, side elevation view of an improved camper jack forming an alternate embodiment of the invention.
Figure 3:
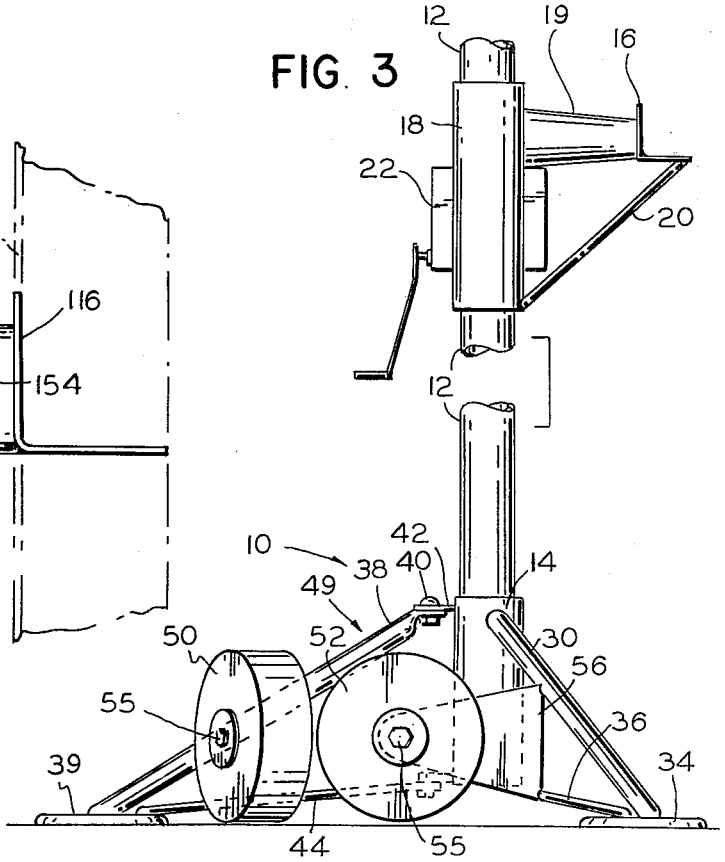
FIG. 3 is an enlarged, fragmentary, elevation view of the jack of FIG. 1.

Referring now in detail to the drawings, there is shown in FIGS. 1–3 an improved camper jack including a tripod type base 10 supporting a tubular post 12 in a tubular socket 14. A saddle 16 is fixed to a tubular slide 18 by an offset 19 and braces 20 fixed to the slide and the saddle. A winch 22 on the saddle is adapted to selectively take up or let out a cable 24 secured at its outer end to the slide and passing over a pulley 26 mounted on the top of the post, and the winch is, of course, lockable to hold the cable against paying out from a load on the saddle.

The tripod base 10 gives firm footing and stability even when a camper coach (not shown) on the saddle is elevated. The base includes two tubular legs 30 and 32 fixed rigidly to the socket 14 and to feet or pads 34 and braces 36 are fixed rigidly to the socket, the pads and the outer ends of the legs. A folding or hinged leg 38 welded to a foot or pad 39 is pivotally connected by a bolt 40 to a bracket 42 welded to the socket 14, and a brace 44 welded to the pad 39 and the leg 38 is pivotally connected by a bolt 46 to a bracket 48 welded to the socket 14. The bolts 40 and 48 are aligned along a hinge axis. The leg 38, the pad 39 and the brace 44 form a leg assembly 49, which is pivotal between an extended operation or jacking position shown in full lines and a folded compact storage position shown in broken lines in FIG. 2 in which the leg assembly lies along the leg 32.

A pair of rollers 50 and 52 are mounted rotatably on offsetting mounting plates 54 and 56. The plate 54 is welded to the leg 38 and the brace 44, and the plate 56 is welded to the leg 30 and the brace 36. When the leg assembly 49 is in its jacking position, the rollers are elevated above the ground as best shown in FIG. 3. When the leg assembly is in its folded position, as shown in broken lines in FIG. 2, the entire jack may be tilted to move the rollers onto the ground and lift the pads 34 and 39 off the ground. The jack then may be rolled to any desired location for lifting or for storing the jack. If the latter, the jack may be tilted to lift the rollers off the ground and be supported by only the pads 34.

The leg 38 and the bracket 42 may be provided with stop means to limit swinging of the leg 38 in a counterclockwise direction as viewed in FIG. 2 to the jacking position thereof. Pivoting of the leg 38 in the opposite direction is limited by the pad 39 engaging the brace 36 and leg 32. The legs 30 and 32 and the pads 34 are all at one side of the post, and the axis of rotation of the rollers 50 and 52 is at the opposite side of the post. When the leg 38 is in its folded or storage position, bolts 55 forming the axles of the rollers are substantially aligned with each other. The legs 30 and 32 preferably are at an angle of about 140° relative to each other and are longer than the bracket 42 and the leg 38 to place the pads 34 out from the post 12 far enough to give excellent stability to the jack when the leg 38 is in its jacking position.

EMBODIMENT OF FIG. 4

An improved camper jack forming an alternate embodiment of the invention is like the jack of FIGS. 1–3 except that a saddle 116 thereof is pivotal relative to a slide 118 on post 112 between a horizontal operative position shown in full lines and a vertical folded or storage position shown in broken lines. The saddle is secured to a tubular socket 151 rotatable on a tubular offsetting member 152. A bolt 153 extends through vertically aligned holes in the socket 151 and member 119 to hold the saddle in its horizontal position. To hold the saddle in its vertical position, the bolt is passed through holes 153 in the socket 151 and the vertical holes in the member 119. When the saddle is folded, the jack takes up very little space.

What is claimed is:

1. In a tripod camper jack,
post means,
carrier means movable up and down the post means,
a pair of fixed leg means rigidly fixed to the post means,
folding leg means,
means mounting the folding leg means pivotally on the post means for movement between a jacking position extending away from the pair of fixed leg means and a storage position extending along one of the fixed leg means,
a first roller mounted on the other of the fixed leg means in a raised position when the folding leg means is in its jacking position,
and a second roller mounted on the folding leg means in a raised position when the folding leg means is in its jacking position,
the rollers being positioned away from the leg means and adapted to engage the ground when the post means is tilted and the folding leg means is in its storage position.

2. The tripod camper jack of claim 1 wherein the fixed leg means are at one side of the post means.

3. The tripod camper jack of claim 2 wherein the rollers are rotatable on an axis positioned at the other side of the post means when the folding leg means is in its storage position.

4. The tripod camper jack of claim 3 including a pair of offsetting arms mounting the rollers on the folding leg means and said other of the fixed leg means.

5. The tripod camper jack of claim 4 wherein the arms are substantially parallel when the folding leg means is in its storage position.

6. The tripod camper jack of claim 1 including an elongated saddle for engaging a load, and mounting means mounting the saddle on the carrier means for movement between a load-supporting position extending crosswise of the post means and a storage position extending along the post means.

7. The tripod camper jack of claim 6 wherein the mounting means includes an arbor, a sleeve rotatable on the arbor, and pin means for locking the sleeve to the arbor.

* * * * *